US006735905B1

(12) United States Patent
Miller

(10) Patent No.: US 6,735,905 B1
(45) Date of Patent: May 18, 2004

(54) RATCHETING WINDING CONE

(75) Inventor: Willis D. Miller, Arthur, IL (US)

(73) Assignee: CHI Overhead Doors, Inc., Arthur, IL (US)

( * ) Notice: Subject to any disclaimer, the term of this patent is extended or adjusted under 35 U.S.C. 154(b) by 99 days.

(21) Appl. No.: 10/097,668

(22) Filed: Mar. 13, 2002

Related U.S. Application Data

(60) Provisional application No. 60/275,758, filed on Mar. 14, 2001.

(51) Int. Cl.[7] ..... E05F 11/00

(52) U.S. Cl. ..... 49/200; 16/198; 160/191; 160/315

(58) Field of Search ..... 49/197, 199, 200, 49/506, 327; 16/198, 197; 160/191, 189, 315, 192

(56) References Cited

U.S. PATENT DOCUMENTS 2,786,231 A * 3/1957 Robinson ..... 16/197
2,982,162 A * 5/1961 Golden ..... 81/176.3
3,567,133 A * 3/1971 Gewinner ..... 239/533.6
3,630,261 A * 12/1971 Gley ..... 411/315
3,651,719 A * 3/1972 Wessel ..... 81/63.2
3,779,537 A * 12/1973 Kalister ..... 267/166.1
4,095,494 A * 6/1978 Castoe ..... 81/63.2
4,114,560 A * 9/1978 Wegmann ..... 116/272
4,720,223 A * 1/1988 Neights et al. ..... 411/11
4,828,442 A * 5/1989 Duran ..... 411/353
4,981,165 A * 1/1991 Miller et al. ..... 160/191
5,024,073 A * 6/1991 Lloyd ..... 70/491
5,239,777 A * 8/1993 Husselton ..... 49/200
5,275,223 A * 1/1994 Magro et al. ..... 160/191
5,605,079 A * 2/1997 Way ..... 81/61
6,125,582 A * 10/2000 Mondragon et al. ..... 49/200
6,263,541 B1 * 7/2001 Scates ..... 16/198
6,401,793 B1 * 6/2002 Martin ..... 160/191
6,508,461 B1 * 1/2003 Trevorrow et al. ..... 267/155

* cited by examiner

*Primary Examiner*—Daniel P. Stodola
*Assistant Examiner*—Khoa Tran
(74) *Attorney, Agent, or Firm*—Philip L. Bateman

(57) ABSTRACT

A ratcheting system is used to wind a helical torsion spring around a torsion bar in a counterbalancing mechanism for an overhead door having multiple panel sections. The ratcheting system contains: (1) a cylindrical sleeve encompassing the torsion bar, the sleeve having longitudinal channels and being secured to the torsion bar at the winding end of the torsion spring; (2) a winding cone adapted to fit over the cylindrical sleeve and having a cone-shaped section connected to the winding end of the torsion spring, a plurality of radial openings for receiving winding bars, a first threaded radial opening containing a set screw, and a second threaded radial opening containing a pull pin, the pull pin having a spring-biased beveled projection that extends inwardly from the winding cone to contact the longitudinal channels of the cylindrical sleeve.

6 Claims, 4 Drawing Sheets

RATCHETING WINDING CONE

CROSS-REFERENCE TO RELATED APPLICATION

This application claims the benefit of U.S. Provisional Application Serial No. 60/275,758, filed Mar. 14, 2001.

FIELD OF THE INVENTION

This invention relates to overhead doors having torsion spring counterbalancing systems.

BACKGROUND OF THE INVENTION

Overhead doors are widely used to close large openings in residential garages, commercial buildings, and industrial buildings. Overhead doors are made of multiple hinged panels with attached rollers that travel along tracks mounted on each side of the opening. Each track contains a vertical section adjacent the opening, an elevated horizontal section extending into the building, and a curved section connecting the vertical and horizontal sections. Some overhead doors are opened and closed manually while others contain powered operators. The doors are typically so heavy that a counterbalancing system is used to reduce the net downward force exerted by the door. Without the counterbalancing system, the force necessary to raise the door would exceed the capabilities of most persons and most powered operators.

Most counterbalancing systems contain either torsion springs or extension springs. A torsion spring is a helical spring that fits like a sleeve over a torsion bar mounted above the door. Cables are attached to the bottom of each side of the doors and then wound around drums on each end of the torsion bar. Extension springs are mounted horizontally along the horizontal section of the track. Torsion springs are generally preferred over extension springs for several reasons, including durability, noise, and smoothness of operation.

The most difficult and dangerous step in assembling a torsion spring counterbalancing system is the winding of the spring. The winding of a spring in a conventional system is illustrated in FIG. 1. A conventional counterbalancing system 10 includes a torsion bar 20, drums 30 and 31, a torsion spring 40, a stationary cone 50, and a winding cone 60. The stationary cone is attached to one end of the spring and the winding cone is attached to the other end. The stationary cone is secured to a bracket 70 which serves to anchor one end of the spring. Before winding the torsion spring, the rotation of the torsion bar must be restrained. In FIG. 1, rotation is restrained by fastening locking pliers onto the torsion bar. The pliers are then wedged against the header. The next step is to insert winding bars 100 and 101 into two of the four radial receptacles in the winding cone. The installer 110 (partially shown) then begins rotating the winding cone. With every quarter turn, a winding bar is removed and re-inserted into another receptacle. As the winding continues, a large amount of torque is created in the spring. When the spring is sufficiently wound (typically about seven rotations), the winding cone is secured to the torsion bar with set screws or the like. If for any reason during the winding process the installer loses his grip on the winding bars or if the winding bars slip out of the receptacles, the spring will rapidly unwind. The rapid unwinding can propel the winding bars outward and cause personal injury and property damage.

Winding of the torsion spring is frequently attempted by homeowners after installation. Over time, an adjustment of the torsion on the spring is often necessary. Typically, the spring needs to be wound slightly tighter to compensate for the slight loss in force due to repeated use. The winding operation is especially dangerous in this situation for two reasons. First, the homeowner is usually inexperienced. Second, when the torsion spring is originally wound, the installer begins the operation with an unwound spring and becomes familiar with the operation as the spring tension increases. In contrast, when the homeowner seeks to wind the spring tighter, the spring is already tightly wound. As a result, the homeowner is often unprepared to handle. the torque when the winding cone is loosened.

Alternative winding systems have been disclosed. For example, Mullet, U.S. Pat. No. 5,419,010, issued May 30, 1995, discloses a counterbalancing system in which the helical torsion spring is mounted inside the torsion bar. The spring is wound by using a conventional hex socket and electric drill to turn a worm gear. Carper et al., U.S. Pat. No. 5,632,063, issued May 27, 1997, also discloses a counterbalancing system in which the torsion spring is wound by using a tool to turn a worm gear. Such systems are relatively expensive, are not compatible with conventional components, and are difficult to install. Accordingly, a demand exists for a torsion spring counterbalancing system that is similar to conventional systems, but makes winding easier and safer.

SUMMARY OF THE INVENTION

The general object of this invention is to provide an improved torsion spring counterbalancing system for overhead doors. A more particular object is to provide a counterbalancing system that makes winding the torsion spring easier and safer by use of a ratcheting mechanism. Another more particular object is to provide a ratcheting counterbalancing system that is relatively inexpensive, compatible with conventional components, and is easy to install. Another more particular object is to provide an improved winding cone.

I have invented an improved ratcheting system for winding a helical torsion spring having a stationary end and a winding end around a torsion bar in a counterbalancing system for an overhead door having multiple panel sections. The ratcheting system comprises: (a) a cylindrical sleeve encompassing the torsion bar, the sleeve having longitudinal channels and being secured to the torsion bar at the winding end of the torsion spring; and (b) a winding cone adapted to fit over the cylindrical sleeve and having a cone-shaped section connected to the winding end of the torsion spring, a plurality of radial openings for receiving winding bars, a first threaded radial opening containing a set screw, and a second threaded radial opening containing a pull pin, the pull pin having a spring-biased beveled projection that extends inwardly from the winding cone to contact the longitudinal channels of the cylindrical sleeve. When the winding cone is rotated in a first direction with the bevel of the projection leading, the beveled projection passes over the longitudinal channels and when the winding cone is rotated in the opposite direction with the bevel of the projection trailing, the beveled projection engages the longitudinal channel and prevents further rotation.

This ratcheting system is compatible with conventional components and serves as a replacement for the conventional winding cone. It is relatively inexpensive and is easy to install. The ratcheting mechanism ensures the torsion spring will not unwind unless desired. It therefore makes the winding of the torsion spring much easier and safer.

DETAILED DESCRIPTION OF THE INVENTION

Figure 1:
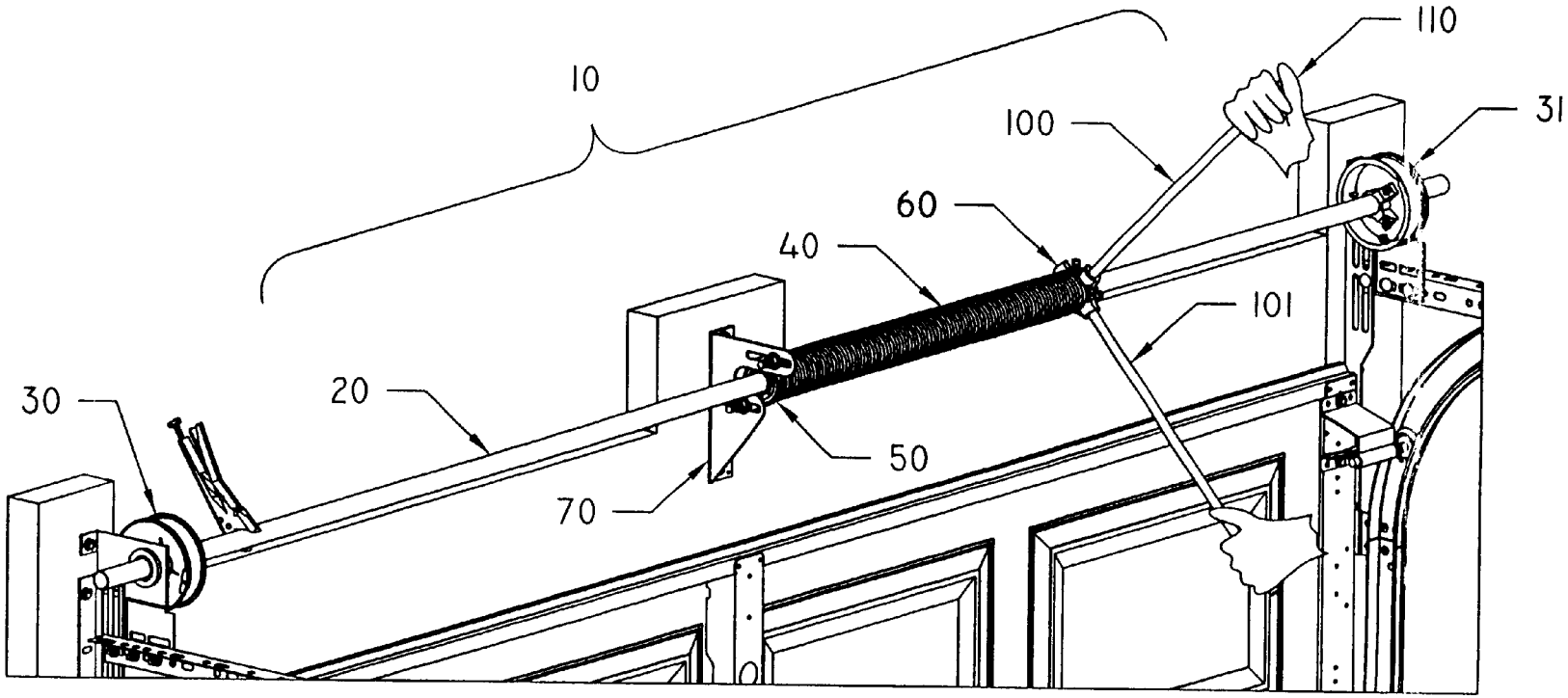
FIG. 1 PRIOR ART
FIG. 1 is a perspective view of a conventional overhead door counterbalancing system.
Figure 2:
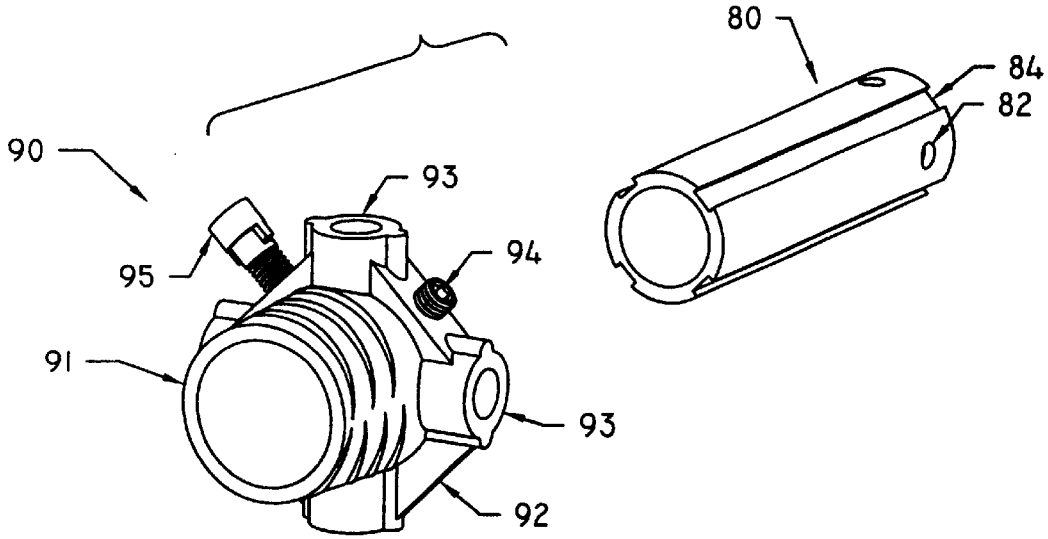
FIG. 2 is a perspective view of a preferred embodiment of the winding cone and mating sleeve of this invention.

This invention is best understood by reference to the drawings. The ratcheting system of this invention replaces (is a substitute for) the conventional winding cone 60 shown as part of a conventional torsion spring counterbalancing system in FIG. 1. As best seen in FIG. 2, the ratcheting system contains a cylindrical sleeve 80 and a ratcheting winding cone 90. The ratcheting system is shown attached to the torsion spring and the torsion bar in FIGS. 7 to 10.

Figure 3:
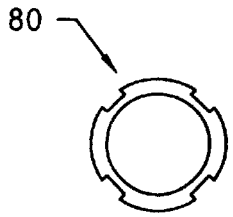
FIG. 3 is a front view of the mating sleeve.
Figure 4:
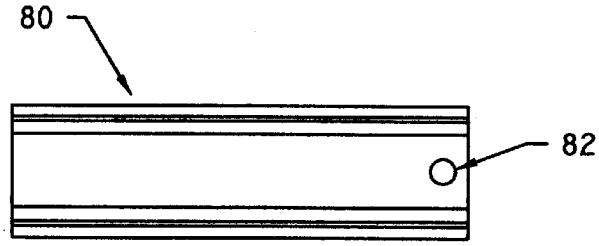
FIG. 4 is a side view thereof.

The cylindrical sleeve is shown in detail in FIGS. 3 and 4. It has an inside diameter sized to enable the sleeve to slide over the torsion bar in a close fit. The cylindrical sleeve is then fastened to the torsion bar. In the preferred embodiment, the sleeve has two threaded openings 82 in its side wall to accept set screw fasteners 83. Locking washers are preferably used with the set screws. The set screws are not shown in FIGS. 2 to 4, but are shown in FIGS. 7 to 10. An alternative means for fastening the sleeve to the torsion bar is to include a threaded opening in the torsion bar to receive a screw that passes through threaded openings in both the sleeve and the torsion bar.

The sleeve has one or more longitudinal channels 84. The number of channels (and the resulting spacing between them) determines the amount of unwinding that can occur before the ratcheting system prevents further unwinding. The sleeve preferably has four equally spaced longitudinal channels. The sleeve is preferably about four to five inches in length. It preferably has a wall thickness of about one-eighth inch with the channels being square cut and having a depth of about one-sixteenth inch. The sleeve is preferably made of galvanized steel.

Figure 5:
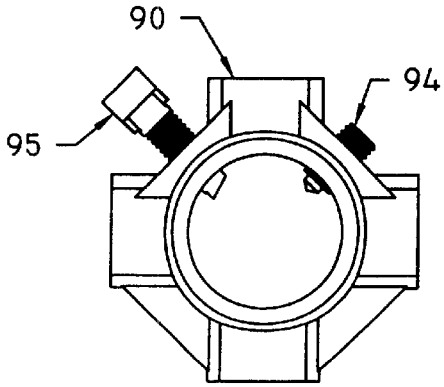
FIG. 5 is front view of the winding cone.
Figure 6:
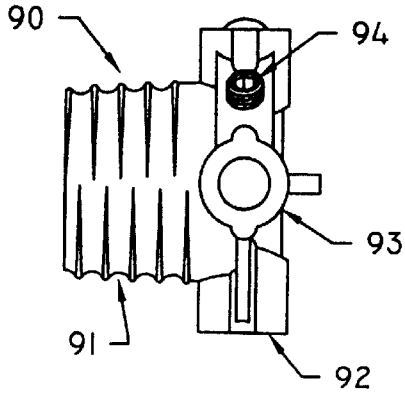
FIG. 6 is a side view thereof.
Figure 9:
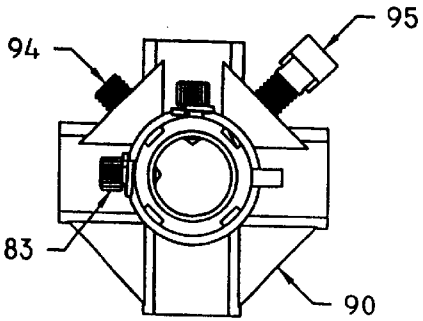
FIG. 9 is an end view thereof with the set screw and the pull pin in the extended positions.
Figure 8:
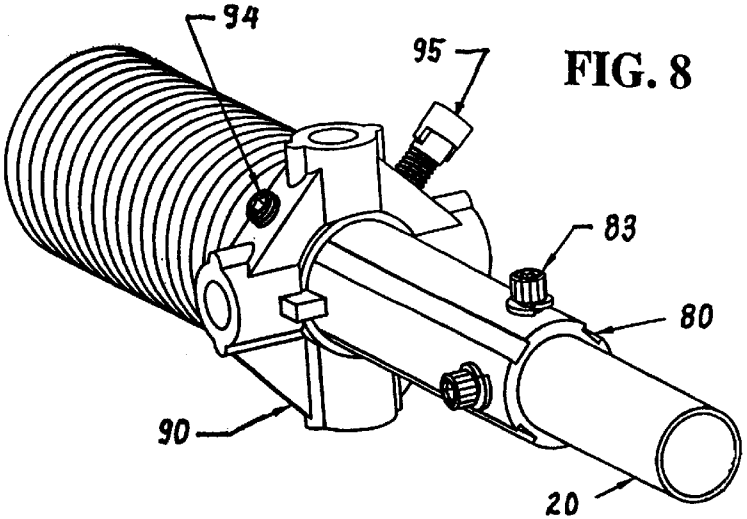
FIG. 8 is similar to FIG. 7 except from a different angle.
Figure 7:
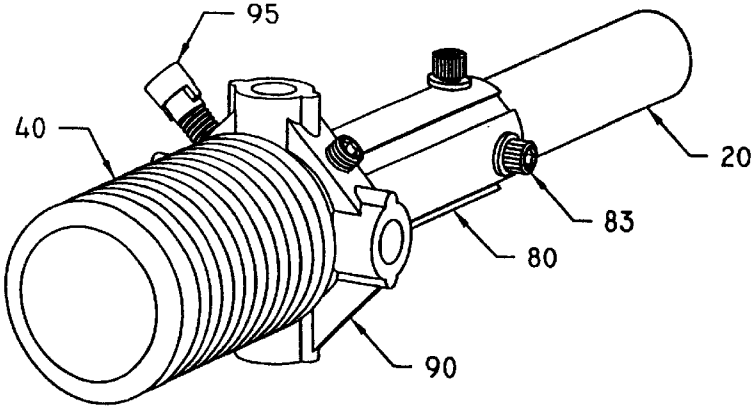
FIG. 7 is a perspective view showing the winding cone and mating cylindrical sleeve connected to a torsion spring and a torsion bar.

The ratcheting winding cone is shown in detail in FIG. 5 and 6. The ratcheting winding cone is similar to a conventional winding cone in that it contains a cone-shaped section 91 for connection to the winding end of the torsion spring and a flange section 92 with radial openings 93 for receiving winding bars and one or more set screws 94 for securing the winding cone is place after the spring is wound. The ratcheting winding cone has two major differences with a conventional winding cone. First, the inside diameter of the ratcheting winding cone is larger so it fits over the cylindrical sleeve. Second, the ratcheting winding cone has a pull pin 95 in place of an additional set screw.

Figure 13:
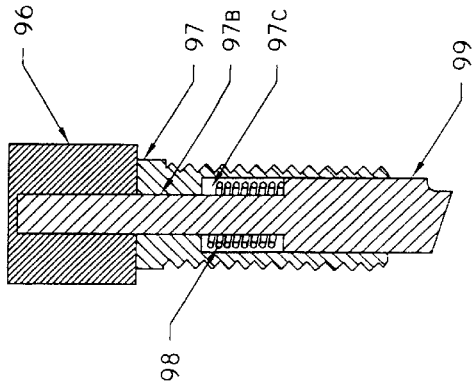
FIG. 13 is a sectional view thereof taken along section A-A in FIG. 12.
Figure 14:
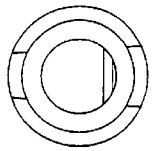
FIG. 14 is a bottom view thereof.
Figure 15:
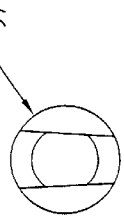
FIG. 15 is a top view of the case of the pull pin.
Figure 16:
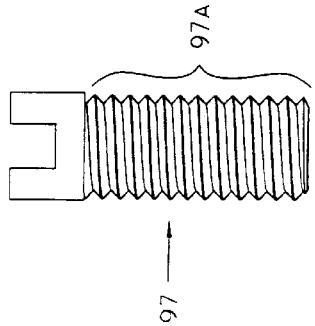
FIG. 16 is a front view thereof.

The pull pin is shown in detail in FIGS. 11 to 16. The pull pin consists of a hold pin 96, a case 97, a spring 98, and a pin 99. The case contains external threads 97*a* at its lower end and, as best seen in FIG. 13, contains a through bore 97*b* with a counter bore 97*c* extending from its lower end. The projecting tip of the pin is beveled along a single plane. The pull pin is threaded into the flange of the winding cone until the beveled (cut-away) edge of the pin is flush with the inside of the cone. This leaves the non-beveled (uncut-away) edge of the pin extending a distance of about one-sixteenth inch inwardly from the cone. The pull pin is oriented in the ratcheting winding cone so the beveled edge of the pin is leading when the winding cone is rotated in a direction that increases the torque in the spring. The hold pin and the case are preferably constructed so that the hold pin fits in the case in only one direction to ensure the beveled edge of the pin is pointed in the desired direction. As best seen in FIGS. 15 and 16, the case in the preferred embodiment contains a slot with converging walls into which the mating hold pin fits.

The installation and operation of the ratcheting system can now be considered. The overhead door and counterbalancing system are installed in the conventional manner with two exceptions. First, the ratcheting winding cone is connected to the torsion spring in place of a conventional winding cone. Second, the cylindrical sleeve is placed onto the torsion bar and slid along the torsion bar toward the ratcheting winding cone. When the sleeve contacts the cone, the sleeve and cone are rotated relative to each other so that one of the channels aligns with the pull pin. The sleeve is then inserted into the cone a short distance and fastened to the torsion bar. The projecting portion of the pull pin rests in one of the channels of the sleeve.

The torsion spring can then be wound in the conventional manner. Rotation of the torsion bar is restrained, winding bars are inserted in the ratcheting cone, and the installer begins rotation. As the ratcheting winding cone rotates, the leading, beveled edge of the pin slides up and over the wall of the channel and the pin retracts. The pin continues to successively extend and retract as the ratcheting winding cone rotates over the sleeve. The extension of the pin makes a clicking noise that enables the installer to easily count the number of rotations that are being made. When the winding has generated the desired torque in the spring, the winding cone is positioned so the pin is projecting into a channel and then the set screw is tightened. The winding of the torsion spring lengthens the spring and the ratcheting winding cone moves longitudinally along the sleeve toward the flange.

Figure 10:
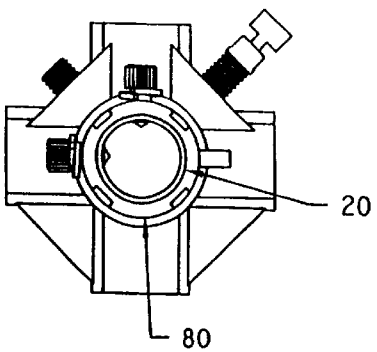
FIG. 10 is an end view thereof with the set screw and the pull pin in the retracted positions.
Figure 11:
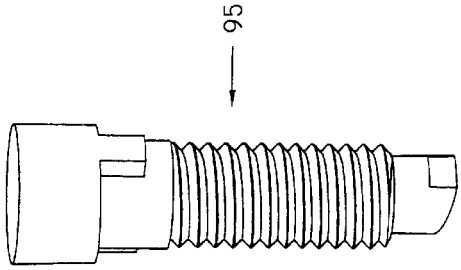
FIG. 11 is a perspective view of the pull pin.
Figure 12:
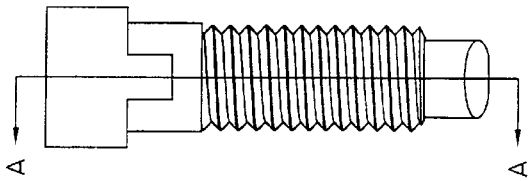
FIG. 12 is a front view thereof.

If additional torque is needed, the winding bars are inserted, the set screw on the ratcheting winding cone is loosened, and the cone is further rotated. If less torque is needed, winding bars are inserted, the pull pin is pulled to allow the non-beveled edge of the pin to clear each desired channel (as shown in FIG. 10), and the winding cone is allowed to rotate backwards.

It can be seen that the ratcheting system greatly reduces the danger associated with winding the torsion spring. If for any reason during the winding process the installer loses his grip of the winding bars or if the winding bars slip out of the receptacles, the unwinding of the spring is stopped when the non-beveled edge of the pin engages the next channel.

It can also be seen that the purpose of the cylindrical sleeve is to provide the longitudinal channels which are engaged by the pin of the winding cone. The use of the cylindrical sleeve thus enables a conventional torsion bar without longitudinal channels to be used. It follows that the cylindrical sleeve is not necessary if a non-conventional torsion bar having longitudinal channels is used.

I claim:

1. A ratcheting system for winding a helical torsion spring around a torsion bar in a counterbalancing system for an overhead door having multiple panel sections, the torsion spring having a stationary end and having a winding end, the ratcheting system comprising:

(a) a cylindrical sleeve encompassing the torsion bar, the sleeve having longitudinal channels and being secured to the torsion bar at the winding end of the torsion spring; and (b) a winding cone that is separate from the cylindrical sleeve, fits over the cylindrical sleeve, and rotates independently from the cylindrical sleeve as the torsion spring is wound, the winding cone having a cone-shaped section connected to the winding end of the torsion spring, a plurality of radial openings for receiving winding bars, a first threaded radial opening containing a set screw, and a second threaded radial opening containing a pull pin, the pull pin having a spring-biased beveled projection that extends inwardly from the winding cone to contact the longitudinal channels of the cylindrical sleeve;

such that when the winding cone is rotated in a first direction with the bevel of the projection leading, the beveled projection passes over the longitudinal channels and when the winding cone is rotated in the opposite direction with the bevel of the projection trailing, the beveled projection engages the longitudinal channel and prevents further rotation.

2. The ratcheting system of claim 1 wherein the pull pin comprises: (i) a hold pin; (ii) a case having an upper end and a lower end, the case having external threads at its lower end, the case further having a through bore with a counter bore extending from its lower end; (iii) a helical spring held within the counter bore of the case; and (iv) a beveled pin extending through the bore and counter bore, inside the helical spring, and being attached to the hold pin.

3. The ratcheting system of claim 2 wherein the sleeve has four equally-spaced channels and is secured to the torsion bar with set screws.

4. A counterbalancing system for an overhead door having multiple panel sections, the counterbalancing system comprising:

(a) a torsion bar having two ends; and (b) drums secured to each end of the torsion bar;

(c) cables running from the drums to the door;

(d) a torsion spring around the torsion bar, the torsion spring having a stationary end and having a winding end; and (e) a ratcheting system for winding the torsion spring, the system comprising: (i) a cylindrical sleeve encompassing the torsion bar, the sleeve having longitudinal channels and being secured to the torsion bar at the winding end of the torsion spring; and (ii) a winding cone that is separate from the cylindrical sleeve, fits over the cylindrical sleeve, and rotates independently from the cylindrical sleeve as the torsion spring is wound, the winding cone having a cone-shaped section connected to the winding end of the torsion spring, a plurality of radial openings for receiving winding bars, a first threaded radial opening containing a set screw, and a second threaded radial opening containing a pull pin, the pull pin having a spring-biased beveled projection that extends inwardly from the winding cone to contact the longitudinal channels of the cylindrical sleeve; such that when the winding cone is rotated in a first direction with the bevel of the projection leading, the beveled projection passes over the longitudinal channels and when the winding cone is rotated in the opposite direction with the bevel of the projection trailing, the beveled projection engages the longitudinal channel and prevents further rotation.

5. The counterbalancing system of claim 4 wherein the pull pin comprises: (i) a hold pin; (ii) a case having an upper end and a lower end, the case having external threads at its lower end, the case further having a through bore with a counter bore extending from its lower end; (iii) a helical spring held within the counter bore of the case; and (iv) a beveled pin extending through the bore and counter bore, inside the helical spring, and being attached to the hold pin.

6. The counterbalancing system of claim 5 wherein the sleeve has four equally-spaced channels and is secured to the torsion bar with set screws.

* * * * *